United States Patent [19]

Smuda

[11] Patent Number: 4,538,552

[45] Date of Patent: Sep. 3, 1985

[54] PRIMARY AIR DUCT CLEANING APPARATUS FOR RECOVERY BOILERS

[75] Inventor: Robert T. Smuda, Enfield, Conn.

[73] Assignee: Combustion Engineering, Inc., Windsor, Conn.

[21] Appl. No.: 677,635

[22] Filed: Dec. 3, 1984

[51] Int. Cl.[3] ..... F22B 37/48; F23J 3/00

[52] U.S. Cl. ..... 122/387; 122/379; 122/235 B; 15/246; 15/249; 15/104.18

[58] Field of Search ..... 122/1 A, 235 B, 383, 122/379, 387; 15/246, 249, 104.18

[56] References Cited

U.S. PATENT DOCUMENTS

| | | | |
|---|---|---|---|
| 111,036 | 1/1871 | Brase et al. | 122/387 |
| 547,451 | 10/1895 | Radspinner | 15/104.18 |
| 745,642 | 12/1903 | Miller | 122/387 |
| 1,162,393 | 11/1915 | Petrich | 15/104.18 |
| 1,191,236 | 7/1916 | Rigo | 15/104.18 |
| 1,251,480 | 1/1918 | Cross | 122/387 |
| 2,806,237 | 9/1957 | Love | 15/104.18 |
| 3,875,904 | 4/1975 | Astrom | 122/379 |
| 4,333,200 | 6/1982 | Thurow | 15/104.18 |
| 4,365,381 | 12/1982 | Neuman | 15/104.18 |

*Primary Examiner*—Henry C. Yuen

*Attorney, Agent, or Firm*—Arthur L. Wade

[57] ABSTRACT

A primary air duct for a chemical recovery furnace is rectangular in cross section. Smelt accumulates on the walls of the air duct at the furnace end. A scraper structure is comprised of a pair of C-channels hinged together at one end. A mechanism moves the hinged scraper forward so it can be guided into scraping contact with the duct walls. The edges of the C-channels are guided by pin and groove engagement between the channels and the duct walls. The scraper is reciprocated from an inoperative position to a scraping mode by a rod to which force is applied.

2 Claims, 2 Drawing Figures

PRIMARY AIR DUCT CLEANING APPARATUS FOR RECOVERY BOILERS

TECHNICAL FIELD

The present invention relates to mechanically removing accumulations of solid smelt from the walls of the primary air ducts of a chemical recovery furnace. More particularly, the invention relates to a mechanical scraping structure which can be permanently mounted in the recovery furnace air duct.

BACKGROUND ART

In chemical recovery furnaces, smelt is deposited on the inside surfaces of the primary air ducts. When solidified, the layers of smelt build up to form an increasingly serious obstruction to the primary air flowing through the duct to the combustion process in the furnace. At first when this problem arose, it was solved with a manually manipulated steam lance, or a blunt impact bar. From the beginning, this has not been a satisfactory way to remove smelt buildup. A structure which will actually scrape the smelt buildup from the walls of the air duct is desired. These past scrapers have had varying degrees of success, but there is still a problem. A scraping structure is needed which can be permanently mounted in the air ducts and actuated to carry out its scraping function by a mechanically and remotely controlled connection station.

DISCLOSURE OF THE INVENTION

The present invention contemplates a two-part scraper structure hinged together which will permit both halves of the scraper to simultaneously bring their scraping edges to all walls of the air duct.

The invention further contemplates control over the scraping edges by grocve and pin connections between the scraper and the sides of the air duct.

The invention further contemplates a mechanical link between the scraper structure and a reciprocating power means which will move the structure forward to remove smelt, and fold the scraper structure when returning to the inoperative position.

Other objects, advantages and features of this invention will become apparent to one skilled in the art upon consideration of the written specification, appended claims, and attached drawings.

BRIEF DESIGNATION OF THE DRAWINGS

Figure 1:
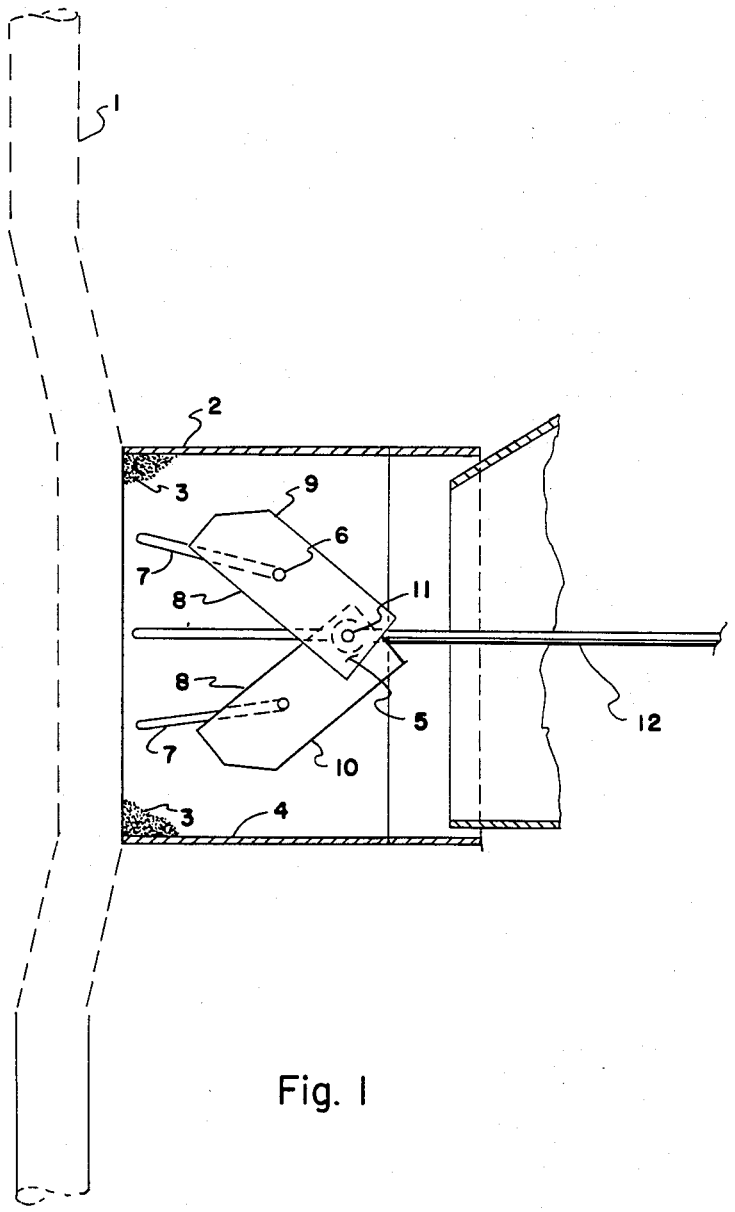
Figure 2:
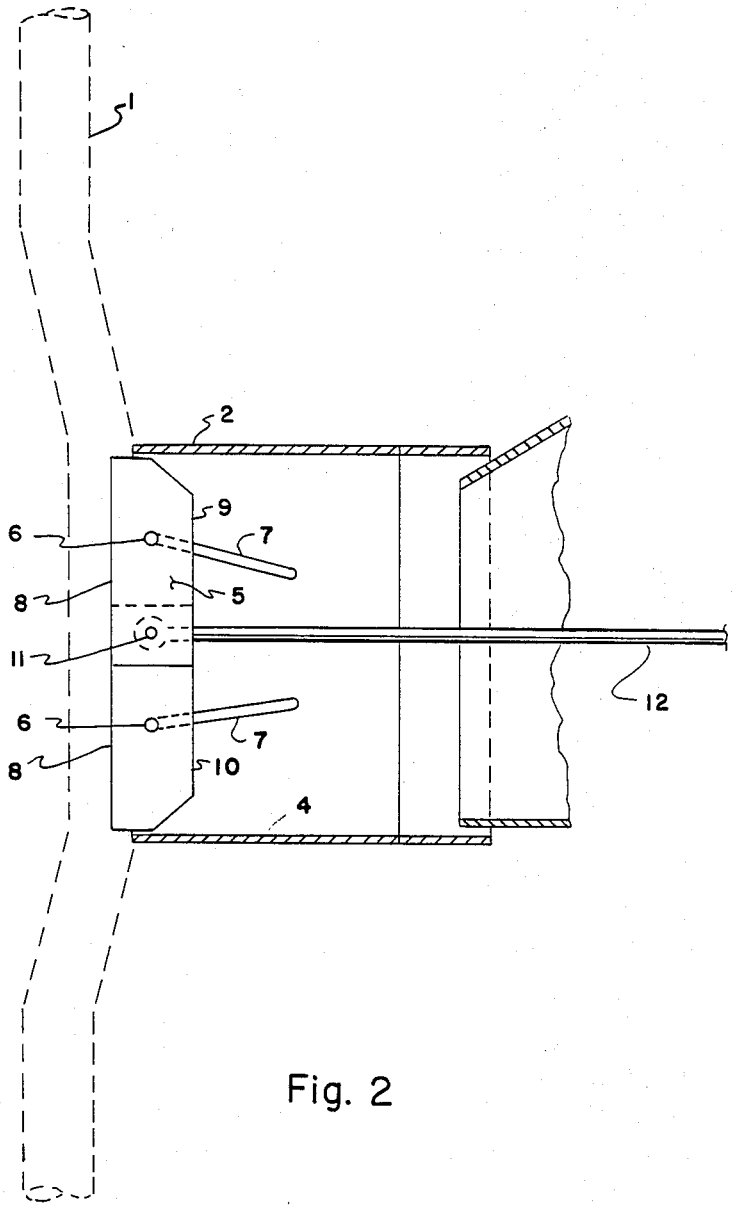

FIG. 1 is a sectioned side elevation of the air duct to be cleaned, showing the scraper structure in its inoperative position and embodying the present invention; and FIG. 2 is the primary air duct of FIG. 1 within which the scraper structure is advanced into contact with the sides of the duct.

BEST MODE FOR CARRYING OUT THE INVENTION

Two positions of the scraper structure are shown in the drawings. FIG. 1 discloses the scraper permanently mounted in the air duct and in its inoperative position. FIG. 2 discloses the scraper advanced to its operative position. In the operative mode, the scraper is reciprocated along the walls of the duct to knock off or scrape off solid or semi-solid layers of smelt. When knocked or scraped off, the smelt is pushed into the furnace. The cleaned duct is thereby returned, substantially, to the designed cross-sectional area.

In the drawings, furnace wall 1 has an opening connected to a rectangular duct 2 through which primary air is supplied. Unfortunately, accumulations of smelt 3 are formed on walls 4 of duct 2 and thereby reduce its cross-sectional area to the flow of primary air. This material must be regularly removed from the walls of the air duct in order to regain satisfactory control of the ratio of fuel and air to permit combustion which takes place within the furnace.

A scraper 5 is moved toward the furnace, carrying the removed smelt and dumping it into the furnace cavity. The scraper is then moved to its inoperative position in duct 2. This position may be termed a storage, as well as inoperative, position.

The drawings depict the novel scraper in its stored and operative positions. FIG. 1 shows the structure in its folded position at the stored location. FIG. 2 shows the structure in its extreme forward position. For guiding the structure along a length of the primary air duct, pins 6,11 are mounted on the scraper and extended to engage grooves 7 formed in the walls 4 of primary air duct 2. Therefore, the storage and operative movements are guided by the pins, and the attached scraper 5 is moved along the grooves to scrape the walls of the air duct.

Scraping Edges

Scraping edges 8 which actually come into contact with and remove the smelt accumulations are on the front and top edges of two main parts of the scraper. These main parts may be termed jaws. Jaws 9 and 10 conform to the general shape of a C-channel. The width of the jaws match, as close as possible, the width of the top and bottom of the primary air duct. The jaws, in their operative mode, clean the entire wall surface of the air duct.

The jaws are pivoted to each other at their rear around a pivot pin 11 through the sides of the jaws. At their inoperative position within the duct, the two jaws are pivoted to each other and folded.

When the scraper is moved toward the furnace, guide pins 6, mounted on the jaws, and pivot pin 11 are engaged within grooves 7 formed in the sides of the air duct. As the scraper is moved forward, the pin and groove connection forces the forward end of jaws 9 and 10 toward their extreme forward position. Thus, as the scraper is moved toward the furnace, the forward edges of the jaws mechanically engage the smelt and scrape it from the walls of the duct to which it has adhered. The scraper may be reciprocated as many times as necessary for the scraping edges to effectively remove the smelt and push it back into the furnace cavity.

Movement Of The Scraper

Again, the channel structures forming the jaws of the scraper are controlled by the pin and groove engagement with the wall of air duct 2. Reciprocation of the scraper brings these jaws together when the scraper is removed to the rear of the duct away from the furnace. Forward movement toward the furnace causes the jaws to pivot around their connection to each other to bring the scraping edges of the jaws into engagement with the smelt-coated surfaces of air duct 2.

A link 12 is connected to the rear of the jaws. A force applied to the link to push the scraper forward will return the scraper to its operative position. Conceivably, the reciprocation results from manual or mechanical force being applied through the connecting link.

Summary

The main elements of the scraper are called "jaws" in that the two main parts of the scraper are pivoted to each other at one end and the opposite ends are "scissored" open as their pins follow the grooves in the walls of the air duct. As the jaws are pivoted at the upstream ends, and guided by the pin and groove combination, the jaws come into contact with the walls of the duct and scrape solid smelt off the surfaces of the duct walls.

From the foregoing, it will be seen that this invention is one well adapted to attain all the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A scraper for removal of solidified layers of smelt on the furnace end of primary air ducts of rectangular cross section, including, a pair of C-channel members having sharp edges and mounted in the air duct to initially extend substantially parallel to the longitudinal axis of the duct, a pivot pin connecting the C-channel members at their upstream ends and extending transverse the duct, guide pins mounted to extend from the outside surface of the C-channel members and extending transverse the duct, a push-pull link attached to the pivot pin with which to reciprocate the C-channel members of the scraper along the air duct, and grooves formed in the side walls of the duct and engaged by the guide pins and pivot pin to bring the sharp edges of the C-channel members of the scraper into contact with the sides of the duct to remove the solid smelt into the furnace.

2. The scraper of claim 1, including, a source of power connected to the push-pull link and periodically activated to reciprocate the link.

* * * * *